US005167916A

United States Patent [19]

Sano et al.

[11] Patent Number: 5,167,916

[45] Date of Patent: Dec. 1, 1992

[54] METHOD FOR SPHERODIZING MOLTEN CAST IRON AND LADLE FOR USE IN THE SPHERODIZING

[75] Inventors: Hiroaki Sano; Takashi Yasukuni; Kiyotaka Nagai, all of Mihara; Hiroo Sato, deceased, late of Mihara, all of Japan, by Kyoko Sato, Chinatsu Sato, Wataru Sato, Toshiyuki Sato

[73] Assignees: Mitsubishi Jukogyo Kabushiki Kaisha, Osaka; Toyo Denka Kogyo Co., Ltd., Kochi, both of Japan

[21] Appl. No.: 738,903

[22] Filed: Aug. 1, 1991

[30] Foreign Application Priority Data

Aug. 2, 1990 [JP] Japan ..... 2-203910
Sep. 18, 1990 [JP] Japan ..... 2-246138

[51] Int. Cl.[5] ..... C22C 33/08
[52] U.S. Cl. ..... 420/20
[58] Field of Search ..... 420/20

[56] References Cited

U.S. PATENT DOCUMENTS 4,210,195 7/1980 McPherson ..... 420/20

OTHER PUBLICATIONS

Patent Abstracts of Japan, vol. 12, No. 37, (C-473)(2884), Feb. 4, 1988.

*Primary Examiner*—Peter D. Rosenberg
*Attorney, Agent, or Firm*—Wenderoth, Lind & Ponack

[57] ABSTRACT

A novel ladle and method for spheroidizing molten iron is disclosed. A cover made of a porous body defining continuous blow holes is mounted at the upper portion of ladle main body containing spheroidizing material therein, and spheroidizing is effected by pouring molten metal into the ladle main body through the porous body cover. Alternatively, the cover is partly cut-away, and spheroidizing is effected by pouring molten metal into the ladle main body through the cut-away portion of the cover.

10 Claims, 5 Drawing Sheets

METHOD FOR SPHERODIZING MOLTEN CAST IRON AND LADLE FOR USE IN THE SPHERODIZING

BACKGROUND OF THE INVENTION

1. Field of the Invention

The present invention relates to a method for spheroidizing molten iron available for producing ductile cast iron, and a ladle for use in the same method for spheroidizing.

2. Description of the Prior Art

In the case of spheroidizing molten iron to produce ductile cast iron, it is a common practice to use a conventional ladle or a ladle provided with a reaction chamber.

When producing ductile cast iron, in order to change the metallurgical structure of graphite from flakes to nodules, spheroidizing is effected by adding or inserting spheroidizing material into molten metal.

The above-mentioned spheroidizing methods include a set pouring method in which spheroidizing material is preliminarily added into a ladle and then molten metal is poured into the ladle, and a candy method in which a block of spheroidizing material (candy type) is inserted into molten metal within a ladle.

The set pouring method in the prior art is shown in FIG. 17, and the candy method in the prior art is shown in FIG. 18.

In the set pouring method in the prior art illustrated in FIG. 17, a necessary amount of spheroidizing material 2 is preliminarily disposed within a ladle main body 1, and cover material 8 for suppressing the reaction is disposed above the spheroidizing material 2.

Molten metal 4 for producing ductile cast iron within a smelting furnace is poured into the ladle main body 1 and spheroidizing of the molten metal 4 is effected.

In the candy method in the prior art illustrated in FIG. 18, after the molten metal 4 for producing ductile cast iron has been poured into the ladle main body 1 in an amount of about 60%, for example, of the ladle capacity, a cover 8 for preventing the splashing of molten metal and provided with a candy rod 9 having a block of spheroidizing material (candy) 2 is set on the ladle main body 1. Thereafter, spheroidizing of the molten metal 4 is effected by inserting the block of spheroidizing material 2 into the molten metal 4.

In the above-described method for spheroidizing molten metal for producing ductile cast iron in the prior art, a violet flash of light and a large amount of white smoke would be generated, and not only does this greatly deteriorate the environment within a factory, but it also becomes a social problem by generating a public hazard.

In addition, because of an abrupt reaction of the spheroidizing material, due to violent bubbling of the molten metal, spheroidizing of molten metal in the amount of only about 60% of the capacity of the ladle can be effected. Also, the risk of generating a hazard due to splashing of the molten metal is large. Therefore, this method presents safety problems.

A known method for resolving these problems involves handling the entire ladle almost as a sealed pressure vessel during spheroidizing. However, this method has not been put to practical use, because the reliability of this method is very poor and the effect produced thereby is not sufficient.

SUMMARY OF THE INVENTION

It is therefore one object of the present invention to provide a method for spheroidizing molten iron and a ladle to be used for spheroidizing molten iron, which can entirely resolve the problems of creating public hazards, deterioration of an environment within a factory, creating dangerous working conditions and poor feasibility (complexity and difficulty).

According to a first aspect of the present invention, there is provided a novel method for spheroidizing molten iron, which is characterized by either one of the following features (1) and (2):

(1) A cover made of a porous body defining continuous blow holes is mounted at the upper portion of a ladle main body containing spheroidizing material therein, and spheroidizing is effected by pouring molten metal into the ladle main body through the same porous body cover.

(2) A cover having a porous body, defining continuous blow holes and partly cut away, is mounted at the upper portion of a ladle main body containing spheroidizing material therein, and spheroidizing is effected by pouring molten metal into the ladle main body through the cut-away portion of the porous body cover.

According to a second aspect of the present invention there is provided a novel ladle for spheroidizing molten iron, which is characterized by one of the following features (3), (4) and (5):

(3) A porous body defining continuous blow holes is disposed over the entirety or part of the upper portion of a ladle main body containing spheroidizing material therein.

(4) The inside of a ladle main body is partitioned into a molten metal receiving section and a spheroidizing section containing spheroidizing material therein, and a cover made of a porous body defining continuous blow holes is provided at the upper portion of the spheroidizing section.

(5) In addition to feature (4) above, a porous body defining continuous blow holes is employed as a partition wall for partitioning the main body into the molten metal receiving section and the spheroidizing section.

According to the present invention having feature (1) above, molten metal is poured into the ladle main body as passing through the cover made of a porous body defining continuous blow holes. At this time, the cover made of a porous body prevents slag from entering into the ladle main body, and so, only molten metal is poured into the ladle.

Within the ladle main body, the molten iron and the spheroidizing material come into contact, resulting in a chemical reaction, and a violent flash of light and a large amount of white smoke (principally composed of MgO) are generated. However, fine particles of the MgO and the like in the white smoke are captured and adsorbed by the cover made of a porous body defining continuous blow holes, whereby dispersion of the white smoke into the atmosphere is greatly suppressed.

On the other hand, gas produced within the ladle main body, as a result of the reaction between the molten iron and spheroidizing material, is discharged into the atmosphere through the cover made of a porous body defining continuous blow holes. Hence, gas pressure within the ladle main body is lowered and bubbling of molten iron is prevented. In addition, a risk of molten cast iron splashing is almost perfectly eliminated.

According to the present invention having feature (2) above, since molten metal is poured into the ladle main body through the cut-away portion of the cover having a porous body mounted thereto, the pouring can be carried out easily and quickly. With regard to the capture and adsorption of white smoke produced by the reaction between the molten iron and spheroidizing material within the ladle main body and the lowering of the gas pressure within the ladle having received the molten metal, the cover having a porous body containing defining blow holes can achieve effects similar to the effects achieved when feature (1) above is adopted.

According to the present invention having feature (3) above, by means of the porous body defining continuous blow holes and provided at the upper portion of the ladle main body, fine particles of white smoke generated upon spheroidizing are captured. Also, the white smoke is suppressed from dispersing to the outside. At the same time, the gas produced is discharged to the outside, whereby gas pressure within the ladle main body is lowered.

Accordingly, bubbling of molten metal within the ladle main body can be prevented, and it suffices to use a comparatively small ladle main body. Also, in accordance with the screening effect of the porous body, splashing of the molten metal can be prevented, whereby safety is ensured.

According to the present invention having feature (4) above, owing to the fact that the inside of a ladle main body is partitioned into a molten metal receiving section and a spheroidizing section and a cover made of a porous body defining continuous blow holes is provided at the upper portion of the spheroidizing section, as when feature (3) above is adopted, fine particles of white smoke generated upon spheroidizing are captured, white smoke is also inhibited from dispersing to the outside, at the same time gas is discharged to the outside to lower gas pressure within the ladle main body, and the splashing of molten metal can be prevented.

In addition, by partitioning the inside of a ladle main body into a molten metal receiving section and a spheroidizing section, pouring of molten metal into the ladle main body becomes easy.

According to the present invention having feature (5) above, owing to the fact that a partition wall for partitioning the main body into the molten metal receiving section and the spheroidizing section is made of a porous body defining continuous blow holes, the above-described effects attributed to feature (4), i.e. the various effects of preventing dispersion of white smoke produced in the spheroidizing section at the time of spheroidizing, and of lowering the pressure of generated gas and preventing the splashing of molten metal, are further enhanced.

The above-mentioned and other objects, features and advantages of the present invention will become more apparent by referring to the following description of preferred embodiments of the invention taken in conjunction with the accompanying drawings.

DETAILED DESCRIPTION OF THE PREFERRED EMBODIMENTS

Figure 1:
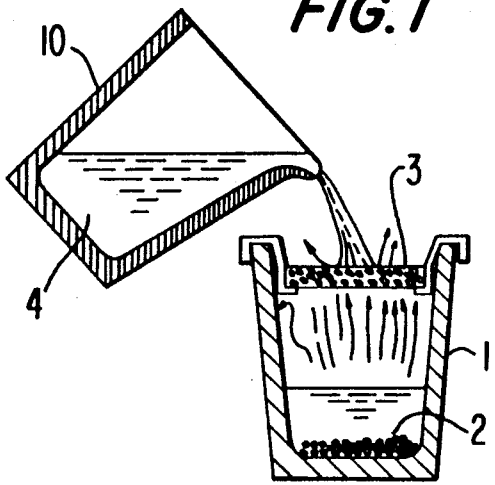
FIG. 1 is a longitudinal cross-sectional view of a first preferred embodiment of the present invention.
Figure 2:
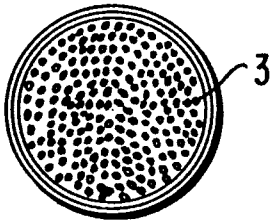
FIG. 2 is a plan view of the same preferred embodiment.

Now, a first preferred embodiment of the present invention will be described with reference to FIGS. 1 and 2.

After a necessary amount of spheroidizing material 2 has been disposed at a predetermined position within a ladle main body 1 (if necessary, cover material could be disposed over the same spheroidizing material 2), a cover 3 made of a porous body containing continuous blow holes (for instance, a gas-permeable heat-resisting filter having a three-dimensional network structure) is mounted over the entire surface of the upper portion of the ladle main body 1.

In this preferred embodiment, the ladle main body 1 is disposed in the proximity of a smelting furnace 10, molten metal 4 for producing ductile cast iron within the smelting furnace 10 is poured onto the porous body 3 having continuous blow holes, and the molten metal 4 is poured into the ladle main body 1 as passing through the cover 3 made of a porous body.

Within the ladle main body 1, the poured molten ductile cast iron 4 and the spheroidizing material 2 come into contact, and as a result of a chemical reaction, violent bubbles and a large amount of smoke and flash are generated.

The above-mentioned cover 3 of a porous body having continuous blow holes prevents slag from mixing into the molten ductile cast iron 4 when it is poured into the ladle main body 1, and it also captures and adsorbs fine particles of MgO and the like in the white smoke produced at the time of spheroidizing, and greatly suppresses dispersion of the white smoke into the atmosphere.

In addition, since gas produced within the ladle main body 1 can be easily discharged into the atmosphere owing to the fact that the cover 3 of a porous body having continuous blow holes has gas-permeability, gas pressure within the ladle main body 1 is extremely lowered. Hence, in cooperation with screening by the cover 3 made of a porous body, a splashing of molten metal is almost entirely eliminated. Also, the bubbling of molten metal is prevented, and so, a large amount of molten metal can be poured into the ladle main body 1.

In this preferred embodiment, the cover 3 of a porous body having continuous blow holes may comprise a ceramic porous body having a three-dimensional network structure (silicon carbide: virtual specific gravity 0.35–0.55, percentage of voids 80–90%, number of cells 6/25 mm □), serving as a heat-resisting filter. When molten cast iron of FCD400 of 50 kg was spheroidized with this structure, the generation of white smoke could be suppressed to about 1/10 of that in the heretofore known method. Also, splashing of molten metal upon reaction could be eliminated.

Next, a second preferred embodiment of the present invention will be described with reference to FIGS. 3 and 4.

A ladle main body 1 is partitioned into a reaction section 1*a* and a molten metal receiving port 5 by means of an upper partition wall 6 made of refractory, which extends downwards from the upper edge of the same ladle main body 1 and has a bottom end spaced upwards from the bottom surface of the ladle main body 1. In the above-mentioned reaction section 1*a* is provided a lower partition wall 7 rising from its bottom surface to form a reaction chamber 1*b* to one side thereof. A cover 3 made of a porous body defining continuous blow holes (for instance, a heat-resisting filter having a three-dimensional network structure) is mounted so as to cover the upper portion of the reaction section la. The above-mentioned molten metal receiving port 5 expands sideways so that the cross section of its upper portion is V-shaped as shown in FIG. 4. It also opens upwards, and thus has a configuration facilitating the receipt of molten metal.

Within the above-described reaction chamber 1*b* is disposed spheroidizing material 2 (if necessary, cover material could be disposed on the same spheroidizing material 2).

In this preferred embodiment, molten metal 4 for producing ductile cast iron within a smelting furnace 10 is poured through the open top of the above-mentioned molten metal receiving port 5, and this molten metal pours through the molten metal receiving port 5 and into the reaction section 1*a*. In this case, since the molten metal receiving port 5 has a configuration facilitating receipt of molten metal from the smelting furnace 10 as described above, the pouring of molten metal from the furnace can be effected easily.

As a result of the molten metal 4 for producing ductile cast iron and the spheroidizing material 2 coming in contact within the reaction chamber 1*b*, flash and white smoke are generated. The generated white smoke is dispersed into the atmosphere as passing through the cover 3 made of a porous body having gas-permeable continuous blow holes. At that time, fine particles of MgO and the like in the white smoke are almost entirely captured and adsorbed by the cover 3 made of a porous body containing continuous blow holes. Hence, the generation of white smoke can be greatly suppressed. Further, gas produced within the reaction section 1*b* by the above-described reaction also passes through the cover 3 made of a porous body having continuous blow holes, resulting in the lowering of the gas pressure within the reaction section 1*b*, whereby the splashing molten metal as well as the bubbling of the molten metal can be prevented.

In addition, due to the above-mentioned upper partition wall 6, an out-flow of the reaction gas from the reaction section 1*a* to the molten metal receiving port 5 can be suppressed during spheroidizing.

A third preferred embodiment of the present invention will be described with reference to FIGS. 5 and 6.

Figure 5:
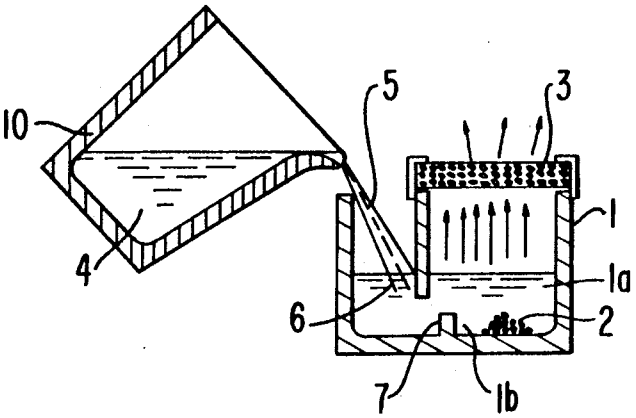
FIG. 5 is a longitudinal cross-sectional view of a third preferred embodiment of the present invention.
Figure 6:
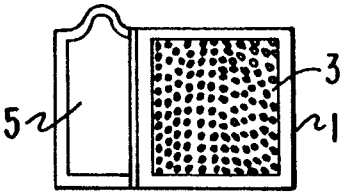
FIG. 6 is a plan view of the same preferred embodiment.

A ladle main body 1 of this preferred embodiment has its molten metal receiving port 5 enlarged and the ladle main body 1 has the configuration of a horizontal drum as shown in FIGS. 5 and 6 for the purpose of facilitating the pouring of molten metal 4 therein from a smelting furnace 10 as well as the pouring of molten metal therefrom into a mold (not shown). Except for the configuration of the ladle main body 1, this preferred embodiment is similar to that of the above-described second preferred embodiment.

Therefore, in this preferred embodiment, the effects of the suppression of white smoke, the prevention of the splashing of molten metal, the prevention of the bubbling of molten metal, ease in operation, etc. can be produced. Also, owing to the large molten metal receiving port 5, the steps of pouring the molten metal 4 for producing ductile cast iron into the ladle main body 1 as well as the pouring of the molten metal 4 therefrom into a mold can be facilitated.

Figure 7:
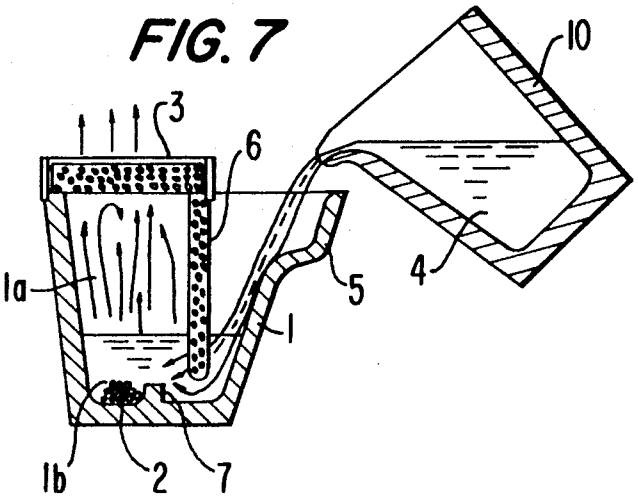
FIG. 7 is a longitudinal cross-sectional view of a fourth preferred embodiment of the present invention.
Figure 8:
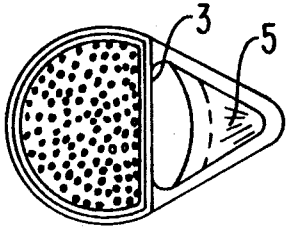
FIG. 8 is a plan view of the same preferred embodiment.

A fourth preferred embodiment of the present invention will be described with reference to FIGS. 7 and 8.

Figure 3:
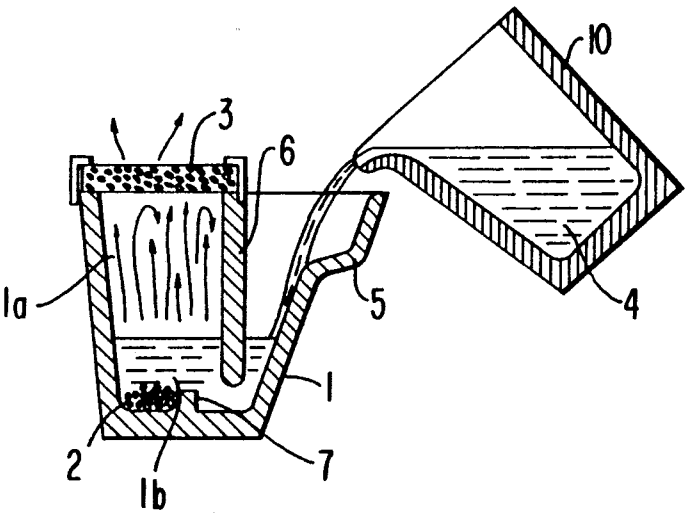
FIG. 3 is a longitudinal cross-sectional view of a second preferred embodiment of the present invention.
Figure 4:
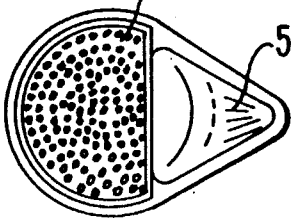
FIG. 4 is a plan view of the same preferred embodiment.

In this preferred embodiment, the upper partition wall 6 in the above-described second preferred embodiment shown in FIGS. 3 and 4 is formed of a porous body defining continuous blow holes (for instance, a gas-permeable heat-resisting filter having a three-dimensional network structure).

This preferred embodiment can achieve the functions and effects possessed by the above-described second preferred embodiment. Also, owing to the upper partition wall 6 made of a porous body having continuous blow holes, it can further lower the gas pressure within the ladle main body 1.

In this preferred embodiment, because the porous ceramic having a three-dimensional network structure (a blend of cordielite and alumina, virtual specific gravity 0.35–0.60, percentage of voids 80–90%, number of cells 13/25 mm □) was used as the material of the cover 3 and the upper partition wall 6, when 500 kg of molten metal of FCD400 was spheroidized, the discharge of white smoke to the atmosphere was almost entirely suppressed, and the splashing of molten metal was also prevented.

It is to be noted that in the above-described respective preferred embodiments, the porous body having continuous blow holes can comprise a porous ceramic having a three-dimensional network structure, such as silicon carbide, a blend of cordielite and alumina, or the like.

Figure 9:
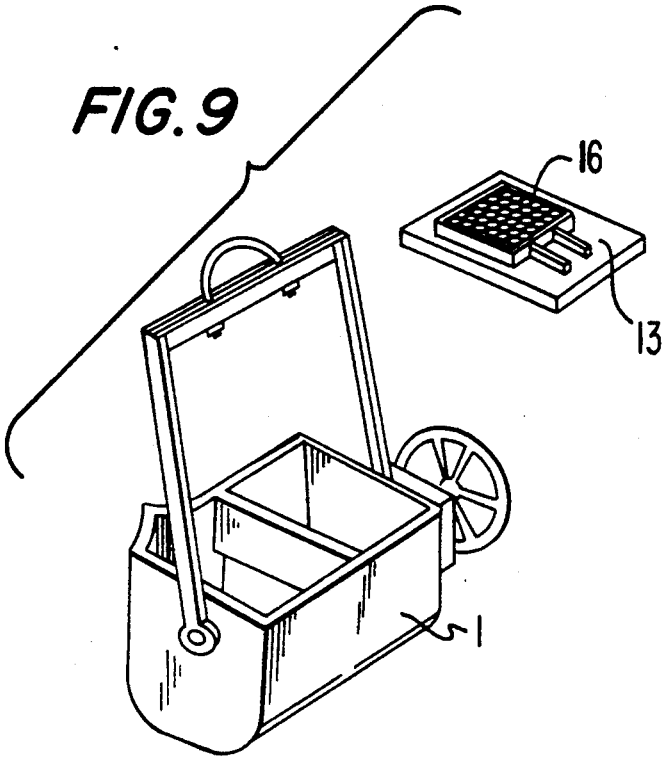
FIG. 9 is a perspective view of a fifth preferred embodiment of the present invention.
Figure 10:
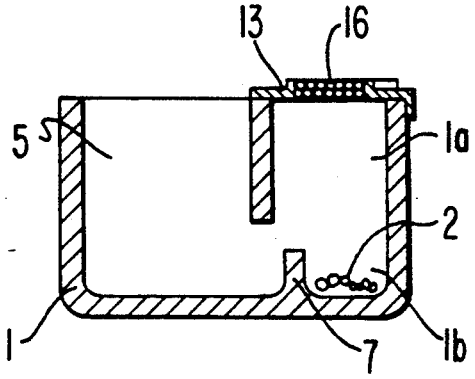
FIG. 10 is a longitudinal cross-sectional view of a ladle in the same preferred embodiment.
Figure 11:
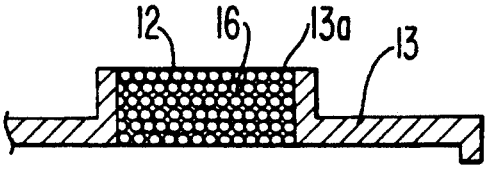
FIG. 11 is a longitudinal cross-sectional view of an essential part of the same preferred embodiment.

A fifth preferred embodiment of the present invention will be described with reference to FIGS. 9 to 11.

In this preferred embodiment, a cover 13 made of metal covers the reaction section 1*a* of a ladle main body of the type used in the above-mentioned third preferred embodiment, and an opening 13*a* (slag removing port) of the same cover 13 is filled with a porous body 16 having continuous blow holes which consists of fine lumpy coke 12.

When fine lumpy coke shown in Table-1 was used as this porous body 16, and 500 kg of molten metal of FCD400 was spheroidized, as in the above-described respective preferred embodiments, the discharge to the atmosphere of white smoke was almost entirely suppressed, and the splashing of molten metal was prevented.

TABLE 1

| Base Material | | Binder, Hardener |
|---|---|---|
| fine lumpy coke grain size: 5 m/m-15 m/m | | (1) water glass + Fe—Si (2) aluminum phosphate + electromolten·Mg fine powder |
| Properties | bulk specific gravity: | 0.585-0.633 g/ml |
| | percentage of voids: | 47-53% |

It is to be noted that in the case where fine lumps of vermiculite, perlite, shirasu-balloon (pumice stone), etc. were employed as the porous body having continuous blow holes, nearly identical results were also obtained.

Figure 12:
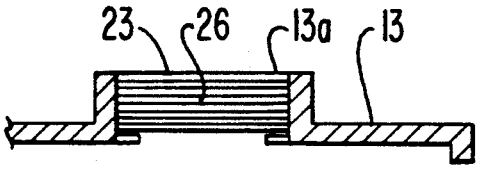
FIGS. 12 and 13 are longitudinal cross-sectional views of essential parts of sixth and seventh preferred embodiments of the present invention.

A sixth preferred embodiment of the present invention will be described with reference to FIG. 12.

In this preferred embodiment, in place of the porous body defining continuous blow holes of the above-described fifth preferred embodiment, a porous body 26 is used. The porous body 26 also defines continuous blow holes and is formed by laminating 8 to 10 various wire net sheets 23 made of stainless steel (size of meshes of a net: 0.75 m/m and 1.50 m/m), and applying refractory (for instance, alumina powder+Georgian kaolin+PVA solution, casting mold wash, or the like) to a surface of the laminate.

In this preferred embodiment, the effects of suppressing white smoke and preventing the splashing of molten metal can also be obtained.

Figure 13:
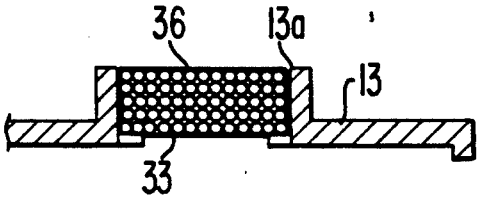

A seventh preferred embodiment of the present invention will be described with reference to FIG. 13.

In this preferred embodiment, in place of the porous body defining continuous blow holes of the above-described fifth preferred embodiment, a porous body 36 is used. This porous body 36 is formed by mixing ceramic balls and small pieces of fibrous refractory (for instance, glass wool, silica wool, etc.), wherein a percentage of voids defined therein is in the range of 50-90%, and sealingly enclosing the prepared binderless refractory in a wire net box 33 made of stainless steel (size of meshes of a net: 0.75 m/m). This porous body 36 thus also defines continuous blow holes.

In this preferred embodiment, the effects of suppressing white smoke and preventing the splashing of molten metal can also be obtained.

Figure 14:
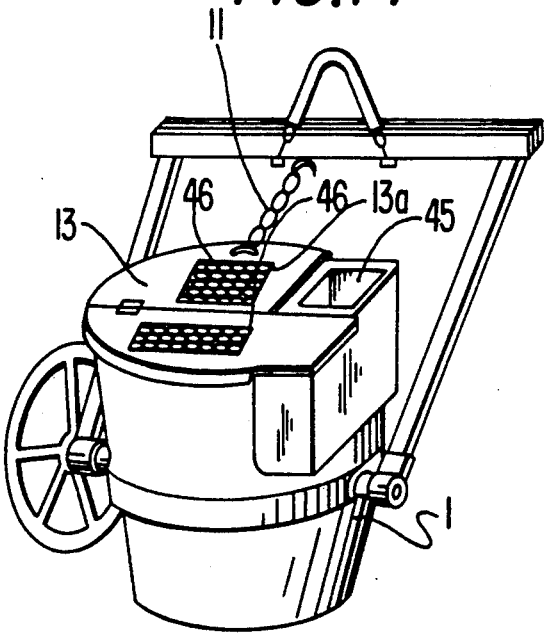
FIG. 14 is a perspective view of an eighth preferred embodiment of the present invention.
Figure 17:
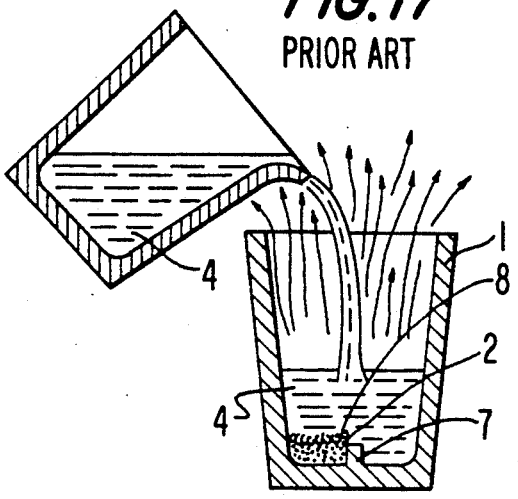
FIG. 17 PRIOR ART
FIGS. 17 and 18 are cross-sectional views illustrating a set pouring method and a candy method, respectively, for spheroidizing molten cast iron in the prior art.
Figure 15:
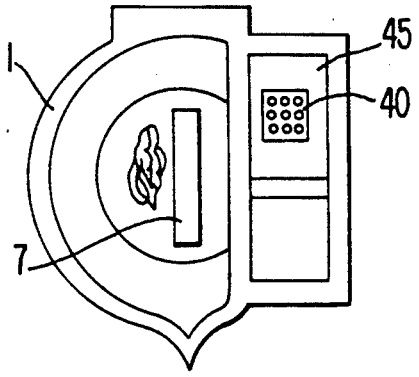
FIG. 15 is a plan view of the same preferred embodiment.
Figure 18:
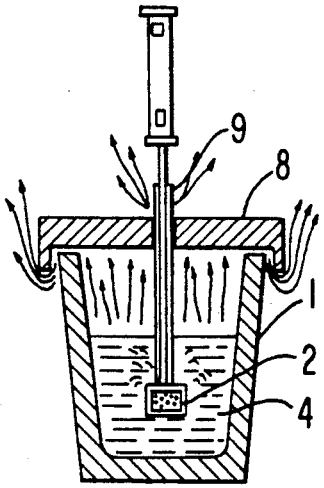
FIG. 18 PRIOR ART
Figure 16:
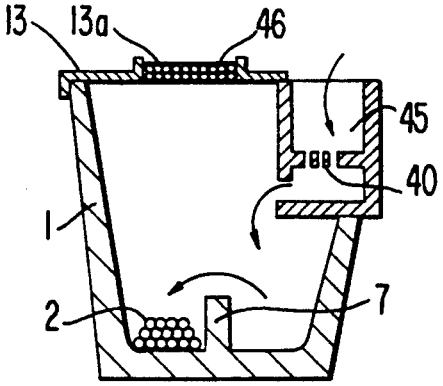
FIG. 16 is a longitudinal cross-sectional view of the same preferred embodiment.

Finally, an eighth preferred embodiment of the present invention will be described with reference to FIGS. 14 to 16.

In this preferred embodiment, the porous body cover and the molten metal receiving section of the ladle main body in the third preferred embodiment are modified in the following manner.

That is, a ceramic porous body 46 defining continuous blow holes (silicon carbide, virtual specific gravity 0.35-0.55, percentage of voids 50-90%, number of cells 20/25 mm □) was fitted in an opening 13*a* of a metallic cover 13 similar to that of the above-described fifth to seventh preferred embodiments.

In addition, for the purpose of allowing the ladle main body 1 to readily receive molten metal, a box-shaped molten metal receiving section 45 is provided. A strainer 40 is disposed under the same molten metal receiving section 45, in an attempt to prevent a mixing of impurities and a discharge of white smoke.

In this preferred embodiment, when 700 kg of molten metal of FCD500 was spheroidized, an effect of suppressing the discharge of white smoke to the atmosphere as well as an effect of preventing the splashing of molten metal were remarkable, and a yield of magnesium was also greatly improved. In addition, a lowering of the temperature of molten metal was small as compared to when the method in the prior art is carried out, and improvements in quality could also be achieved.

As will be obvious from the detailed description of preferred embodiments above, the present invention can provide the following advantages owing to the fact that a cover made of a porous body defining continuous blow holes is mounted to a ladle main body in which the spheroidizing of molten metal iron is carried out:

(1) The amount of white smoke, produced during the reaction between the molten iron and spheroidizing material, which is discharged to the atmosphere can be greatly suppressed. Therefore, the invention is an effective countermeasure against the creation of a public hazard.

(2) Gas pressure generated within a ladle by the reaction between molten iron and spheroidizing material can be decreased, and by reducing the splashing of molten metal, safety is improved.

(3) By reducing an amount of the splashing of molten metal (bubbling), the ladle main body can be small.

(4) As compared to a ladle provided with a top cover in the prior art, the ladle of the present invention can be lighter, and it is easier to manipulate.

In addition to the above-mentioned advantages, according to the present invention, owing to the fact that molten metal is poured into the ladle main body as passing through the cover made of a porous body, slag does not mix with the molten metal, and hence, the ductile cast iron produced is of high quality.

Also, according to the present invention, molten metal can be poured into the ladle main body through a cut-away portion of the cover made of a porous body. Accordingly, pouring of the same molten metal can be carried out in a short period of time and easily.

Next, the following effects can be produced because of the fact that a porous body defining continuous blow holes is disposed over entirety or a part of the upper portion of the ladle:

(1') The amount of white smoke, produced by the reaction between molten iron and spheroidizing material, which is discharged to the atmosphere can be greatly suppressed. Therefore, the invention is an effective countermeasure against creating a public hazard.

(2') Gas pressure generated within a ladle by the reaction between molten iron and spheroidizing material can be decreased, and in conjunction with a screening effect provided by the porous body, safety is improved by reducing the splashing of the molten metal.

(3') By reducing an amount of the splashing of molten metal (bubbling), the ladle main body can be small.

(4') As compared to a ladle provided with a top cover in the prior art, the ladle of the present invention can be lighter, and it is easier to manipulate.

(5') Owing to the fact that molten metal can be poured into the ladle main body as passing through the cover made of a porous body, slag does not mix with the molten metal. Hence, the ductile cast produced is of high quality.

Also according to the present invention, the inside of a ladle main body can be partitioned into a molten metal receiving section and a spheroidizing section and a cover made of a porous body defining continuous blow holes is provided at the upper portion of the spheroidizing section. Therefore, effects similar to the above-described effects (1') to (4') can be achieved. Also, the pouring of molten metal into the ladle main body can be carried out easily, and so, operability is facilitated.

Still further according to the present invention, the partition wall for partitioning the ladle main body into the molten metal receiving section and the spheroidizing section can be formed of a porous body defining continuous blow holes. Therefore, the above-mentioned effects of lowering gas pressure within the molten metal receiving section, preventing white smoke from dispersing to the outside and preventing the splashing of molten metal can be further enhanced.

While principles of the present invention have been described above in connection with a number of preferred embodiments of the invention, it is intended that all matter contained in the above description and illustrated in the accompanying drawings be interpreted as illustrative of and not as a limitation on the scope of the present invention.

What is claimed is:

1. A method of spheroidizing molten iron, said method comprising:

providing a ladle having an open upper portion communicating with the interior of the ladle;

disposing spheroidizing material, capable of spheroidizing molten iron, in the ladle;

covering the open upper portion of the ladle with a cover comprising a porous body defining continuous blow holes extending therethrough; and pouring molten metal into the ladle through the porous body, whereby when the molten metal and spheroidizing material react within the ladle, white smoke and fumes generated in the ladle are inhibited by the porous body from being discharged from the ladle to the environment outside the ladle while the blow holes defined by the porous body allow pressure of gas produced in the ladle during spheroidizing to be relieved.

2. A method of spheroidizing molten iron as claimed in claim 1, wherein the step of pouring comprises pouring the molten metal from a smelting furnace into the ladle through the porous body.

3. A method of spheroidizing molten iron, said method comprising:

providing a ladle having an open upper portion communicating with the interior of the ladle;

disposing spheroidizing material, capable of spheroidizing molten iron, in the ladle;

covering only a part of the open upper portion of the ladle with a cover comprising a porous body defining continuous blow holes extending therethrough; and pouring molten metal into the ladle through the part of the open upper portion of the ladle not covered by the cover, whereby when the molten metal and spheroidizing material react within the ladle, white smoke and fumes generated in the ladle are inhibited by the porous body from being discharged from the ladle to the environment outside the ladle while the blow holes defined by the porous body allow pressure of gas produced in the ladle during spheroidizing to be relieved.

4. A method of spheroidizing molten iron as claimed in claim 3, wherein the step of pouring comprises pouring the molten metal from a smelting furnace into the ladle.

5. A method of spheroidizing molten iron as claimed in claim 3, wherein the step of providing a ladle comprises providing a ladle having a partition therein separating the interior of the ladle into a reaction section defined to one side of the partition and a molten metal receiving port defined to the other side of the partition and communicating with the reaction section, the step of disposing the spheroidizing material in the ladle comprises disposing the spheroidizing material in the reaction section, the step of covering only a part of the open upper portion of the ladle comprises positioning the porous body over the reaction section of the ladle, and the step of pouring comprises pouring the molten metal into the molten metal receiving port.

6. A ladle for spheroidizing molten iron, said ladle comprising:

a main body having an open upper portion communicating with the interior thereof; spheroidizing material, capable of spheroidizing molten iron, disposed in said main body; and a porous body defining continuous blow holes extending therethrough covering at least part of the open upper portion of said main body of the ladle, said blow holes being of a size which will allow gas produced by a reaction between molten iron and the spheroidizing material to pass therethrough; whereby when the molten metal and spheroidizing material react within the ladle, white smoke and fumes generated in the ladle are inhibited by the porous body from being discharged from the ladle to the environment outside the ladle while the blow holes defined by the porous body allow pressure of gas produced in the ladle during spheroidizing to be relieved.

7. A ladle for spheroidizing molten iron, said ladle comprising: a main body having an open upper portion communicating with the interior thereof; a partition separating the interior of said main body into a reaction section defined to one side of the partition and a molten metal receiving port defined to the other side of the partition and communicating with the reaction section; spheroidizing material, capable of spheroidizing molten iron, disposed in said reaction section; and a porous body defining continuous blow holes extending therethrough covering the upper portion of said main body at a location over said reaction section, said blow holes being of a size which will allow gas produced by a reaction between molten iron and the spheroidizing material to pass therethrough; whereby when the molten metal and spheroidizing material react within the ladle, white smoke and fumes generated in the ladle are inhibited by the porous body from being discharged from the ladle to the environment outside the ladle while the blow holes defined by the porous body allow pressure of gas produced in the ladle during spheroidizing to be relieved.

8. A ladle for spheroidizing molten iron as claimed in claim 7, wherein said partition comprises a body of porous material defining continuous blow holes extending therethrough.

9. A ladle for spheroidizing molten iron as claimed in claim 8, wherein said partition extends across said main body and has a lower terminal end spaced from the bottom of said main body, and said partition further comprises a lower partition wall extending from the bottom of said main body and spaced from said porous body.

10. A ladle for spheroidizing molten iron as claimed in claim 7, wherein said partition includes an upper partition wall extending across said main body and having a lower terminal end spaced from the bottom of said main body, and a lower partition wall extending from the bottom of said main body and spaced from said porous body.

* * * * *